US010072321B2

(12) United States Patent
Uda et al.

(10) Patent No.: US 10,072,321 B2
(45) Date of Patent: Sep. 11, 2018

(54) COPPER NICKEL ALLOY

(71) Applicants: NGK Insulators, Ltd., Nagoya (JP); Osaka Alloying Works, Co., Ltd., Fukui (JP)

(72) Inventors: Minoru Uda, Nagoya (JP); Takahiro Ishikawa, Toyoake (JP); Taiji Mizuta, Kyoto (JP); Yasunari Mizuta, Fukui (JP); Hiroyasu Taniguchi, Sakai (JP)

(73) Assignees: NGK Insulators, Ltd., Nagoya (JP); Osaka Alloying Works, Co., Ltd., Fukui (JP)

( * ) Notice: Subject to any disclaimer, the term of this patent is extended or adjusted under 35 U.S.C. 154(b) by 360 days.

(21) Appl. No.: 14/749,745

(22) Filed: Jun. 25, 2015

(65) Prior Publication Data

US 2016/0312340 A1 Oct. 27, 2016

(30) Foreign Application Priority Data

Apr. 22, 2015 (JP) ..... 2015-087888

(51) Int. Cl.
*C22C 9/02* (2006.01)
*C22C 9/06* (2006.01)
*C22F 1/08* (2006.01)

(52) U.S. Cl.
CPC ..... *C22C 9/06* (2013.01); *C22F 1/08* (2013.01); *C22C 9/02* (2013.01)

(58) Field of Classification Search
CPC ..... C22C 9/06; C22C 9/02
See application file for complete search history.

(56) References Cited

U.S. PATENT DOCUMENTS 2,887,765 A * 5/1959 Thomson ..... C22C 1/0425 420/418
3,198,499 A 8/1965 Stanley
3,937,638 A 2/1976 Plewes
4,373,970 A * 2/1983 Scorey et al. ..... 419/23
5,019,185 A 5/1991 Nakajima et al.
5,089,057 A 2/1992 Plewes
(Continued)

FOREIGN PATENT DOCUMENTS

GB 2 005 304 A 4/1979
JP 54-57422 A1 5/1979
(Continued)

OTHER PUBLICATIONS

European Search Report, European Application No. 15165273.2, dated Oct. 15, 2015 (6 pages).
(Continued)

*Primary Examiner* — Keith D Walker
*Assistant Examiner* — John A Hevey
(74) *Attorney, Agent, or Firm* — Burr & Brown, PLLC

(57) ABSTRACT

The copper alloy of the present invention contains 5% by mass to 25% by mass of Ni, 5% by mass to 10% by mass of Sn, 0.005% by mass to 0.5% by mass of element A (element A being at least one selected from the group consisting of Nb, Zr and Ti), and 0.005% by mass or more of carbon. In the copper alloy, the mole ratio of the carbon to the element A is 10.0 or less. The copper alloy may further contain 0.01% by mass to 1% by mass of Mn. In this copper alloy, the element A may be present as carbide.

9 Claims, 5 Drawing Sheets

(56) References Cited

U.S. PATENT DOCUMENTS

| | | | | |
|---|---|---|---|---|
| 2008/0202719 | A1* | 8/2008 | Watwe | C22C 1/1036 164/97 |
| 2013/0333812 | A1* | 12/2013 | Ishida | H01B 1/026 148/554 |
| 2014/0261925 | A1 | 9/2014 | Wetzel et al. | |

FOREIGN PATENT DOCUMENTS

| | | | |
|---|---|---|---|
| JP | 07-054079 | A1 | 2/1995 |
| JP | 08-283889 | A1 | 10/1996 |
| JP | 2009-242895 | A | 10/2009 |
| WO | 2008/103688 | A1 | 8/2008 |

OTHER PUBLICATIONS

Materion Brush Inc., et al., "BrushForm® 158 Cold Rolled Tempers," Materion Datasheet [online], <URL:http://materion.com/~/media/Files/PDFs/Alloy/DataSheets/Copper%20Nickel%20Tin%20Strip/Brushforms-DataSheets-Brushform158ColledRolled.pdf>; dated 2011 (1 page).

Jiang, Bohong, et al., "Study of Cu—15Ni—8Sn and Cu—15Ni—8Sn—02Nb Spinodal Decomposition Type Elastic Alloys," (With English Translation), *China Academic Journal Electronic Publishing House*, dated 1989 (20 pages).

Louzon, T.J., et al., "Producing High-Strength Ductile Cu—10Ni—8Sn Alloy Wire," *Wire Journal International*, dated Nov. 1983 (8 pages).

* cited by examiner

COPPER NICKEL ALLOY

BACKGROUND OF THE INVENTION

1. Field of the Invention

The present invention relates to copper alloys.

2. Description of the Related Art

A variety of copper alloys have been devised as high-strength copper alloy used for various types of springs, bearings and the like. For example, PTL 1 discloses a copper alloy that is a Ni—Sn—Cu-based spinodal alloy to which Mn been added to prevent grain boundary precipitation that my occur in copper alloy cast materials. According to PTL 1, when Cr, Mo, Ti, Co, V, Nb, Zr, Fe, Si or the like is added to this copper alloy, Ni—Sn—Mn, Si or those additive elements form a hard intermetallic compound that crystallizes out in the matrix, thus contributing to the increase of wear resistance and seizure resistance. PTL 2 discloses a copper alloy whose strength is increased without reducing the electric conductivity by adding Cr or Zr to copper, and further in which oxides of Cr or Zr are prevented from being formed by controlling the oxygen content to 60 ppm or less. This patent literature describes a technique for adding carbon to a molten material or a molten metal for reducing the oxygen content. Also, PTL 2 discloses that the strength of this copper alloy is increased by adding Ni, Sn, Ti, Nb or the like to the copper alloy, and that grain coarsening is prevented by adding Ti or Nb.

CITATION LIST

Patent Literature

PTL 1: JP 08-283889 A
PTL 2: JP 07-54079 A

SUMMARY OF THE INVENTION

Although the copper alloys of PTLs 1 and 2 exhibit increased wear resistance and seizure resistance, and increased strength without reducing electric conductivity, the ductilities thereof are low in some cases. Accordingly, the copper alloy can be cracked, for example, while being worked, or the elongation of the resulting product can be small. A Cu—Ni—Sn-based copper alloy superior in ductility is desirable.

The present invention is intended to solve these problems, and a major object of the invention is to provide a Cu—Ni—Sn-based copper alloy superior in ductility.

Solution to Problem

In order to achieve the major object, the following copper alloy is provided.

The copper alloy of the present invention contains 5% by mass to 25% by mass of Ni, 5% by mass to 10% by mass of Sn, 0.005% by mass to 0.5% by mass of element A (element A being at least one selected from the group consisting of Nb, Zr and Ti), and 0.005% by mass or more of carbon. In the copper alloy, the mole ratio of the carbon to the element A is 10.0 or less.

The copper alloy of the present invention, is superior in ductility because of the presence therein of appropriate amounts of Ni, Sn, element A (at least one selected from the group consisting of Nb, Zr and Ti), and carbon.

DETAILED DESCRIPTION OF THE INVENTION

Figure 1:
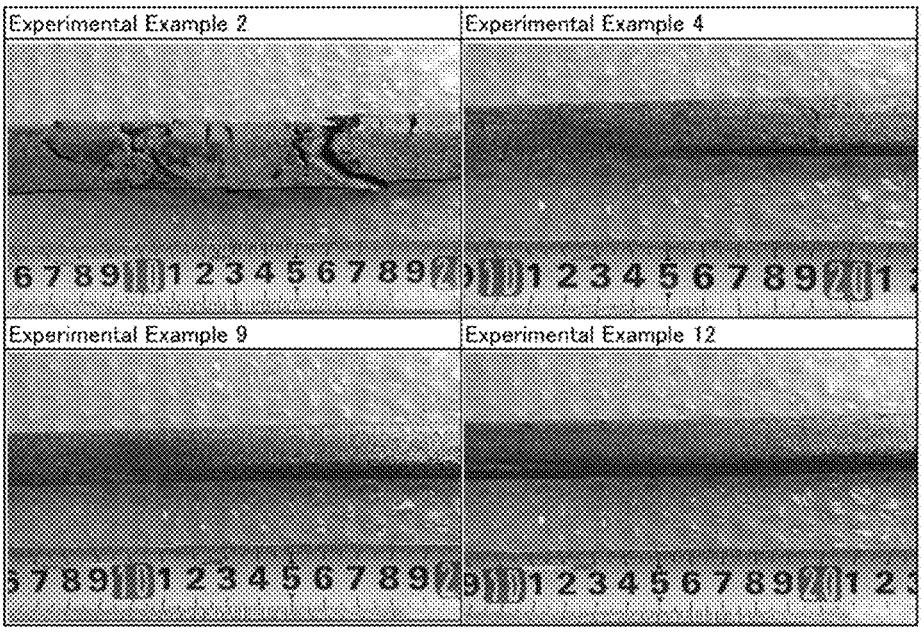
FIG. 1 show photographs of the appearances of copper alloys after being subjected to rolling with a grooved roll in Experimental Examples 2, 4, 9 and 12.

The copper alloy of the present invention, contains 5% by mass to 25% by mass of Ni, 5% by mass to 10% by mass of Sn, 0.005% by mass to 0.5% by mass of element A (element A being at least one selected from the group consisting of Nb, Zr and Ti), and 0.005% by mass or more of carbon. In the copper alloy, the mole ratio of the carbon to the element A is 10.0 or less.

Ni is expected to produce the effect of inducing spinodal decomposition in age-hardening heat treatment subsequent to solution heat treatment, and of thereby increasing the strength of copper alloy. When the Ni content is 5% by mass or more, the strength is more increased; when it is 25% by mass or less, the copper alloy exhibits a high ductility, and decrease in electric conductivity due to the addition of Ni is suppressed. Preferably, the Ni content is more than 10% by mass. A copper alloy containing more than 10% by mass of Ni allows a larger amount of carbon to dissolve in the molten alloy when melted. Thus, such a copper alloy is expected to more efficiently form carbide described later.

Sn is expected to dissolve in the copper alloy to form solid solution, thereby increasing the strength. When the Sn content is 5% by mass or more, the strength is increased; when it is 10% by mass or less, a Sn enriched phase, which can reduce ductility, is not easily formed.

Nb, Zr or Ti added as element A is expected to form a carbide with the carbon in the copper alley, and thus to prevent elemental carbon from precipitating, or to prevent interstitial carbon from penetrating the alloy to form solid solution. When the element A content is 0.005% by mass or more, the amount of carbon unable to form carbide is not excessively increased; When it is 0.5% by mass or less, the molten metal can be so flowable as to prevent casting defects. The element A content may be, for example, in the range of 0.01% by mass to 0.3% by mass. If element A is Nb, the content thereof may be, for example, in the range of 0.01% by mass to 0.1% by mass. If element A is Zr, the content thereof may be, for example, in the range of 0.03% by mass to 0.3% by mass. If element A is Ti, the content thereof may be, for example, in the range of 0.01% by mass to 0.25% by mass. Although at least, part of element A is considered to be present in the form of carbide, element A may be present in a form other than carbide. When element A is present as carbide, the grain size of the carbide may be, for example, in the range of 20 μm or less, or 10 μm or less. If the carbide has an excessively large grain, size, it is a concern that the hard carbide is likely to cause the copper alloy to crack therefrom.

Carbon (C) is expected to form a carbide with element A in the alloy. The carbide is effective in reducing the grain size of the alloy. Carbon with a content of 0.005% by mass or more can form so adequate an amount of carbide as helps form primary crystals in solidification of the alloy, thus reducing the grain size of the cast structure, and/or can function to pin dislocation effectively during solution heat treatment subsequent to hot working and thus to suppress the increase in size of the recrystallized grains. The lower limit of the element A content may be, for example, 0.01% by mass or more. The upper limit of the element A content may be, for example, 0.2% by mass or less, or 0.1% by mass or less.

In the copper alloy of the present invention, the mole ratio of carbon to element A, that is, MC/MA mole ratio, is 10.0 or less, where MA (mol) represents the amount by mole of element A and MC (mol) represents the amount toy mole of carbon (C). When the MC/MA mole ratio is 10.0 or less, the excess carbon unable to form carbide is prevented from retaining in the alloy, and degradation in hot workability and decrease in ductility can be suppressed. The MC/MA mole ratio may be 9.0 or less, or 8.0 or less. The lower limit of the MC/MA mole ratio may be, for example, 0.04 or more, 0.1 or more, or 0.2 or more.

The copper alloy of the present invention may further contain at least one additive element selected from the group consisting of Mn, Zn, Mg, Ca, Al, Si, P, and B. These additive elements, which are dissolved in the copper alloy to form a solid solution, are expected to deoxidize the molten metal or to prevent the grains from increasing in size during solution heat treatment. Mn is more preferred as the additive element. The content of the additive element may be, for example, 1% toy mass or less in total. The content of the additive element is preferably in the range of 0.01% by mass to 1% by mass, more preferably in the range of 0.1% by mass to 0.5% by mass, and still more preferably in the range of 0.15% by mass to 0.3% by mass. When the content of the additive element is 0.01% by mass or more, the above-described effects can be satisfactorily produced. An additive element content of more than 1% by mass however does not produce a further effect corresponding to the amount added.

The copper alloy of the present invention may be based on C72700 alloy having a composition of Cu-9% by mass Ni-6% by mass Sn; an alloy having a composition of Cu-21% by mass Ni-5% by mass Sn; or C72900 or C96900 alloy having a composition of Cu-15% by mass Ni-8% by mass Sn. In the above compositions, the content (percent by mass) of each constituent can be in the range of the corresponding value±1% by mass.

Preferably, the balance of the composition of the copper alloy of the present invention is Cu and inevitable impurities. For example, the copper alloy of the present invention may contain 5% by mass to 25% by mass of Ni, 5% by mass to 10% by mass of Sn, 0.005% by mass to 0.5% by mass of element A (at least one element selected from the group consisting of Nb, Zr and Ti), 0.005% by mass or more of carbon, and the balance being Cu and inevitable impurities, with a carbon-to-element A mole ratio of 10.0 or less. Alternatively, the composition of the copper alloy of the present invention may contain 5% by mass to 25% by mass of Ni, 5% by mass to 10% by mass of Sn, 0.01% by mass to 1% by mass of any of the above-cited additive elements, 0.005% by mass to 0.5% by mass of element A (at least one element selected from the group consisting of Nb, Zr and Ti), 0.005% by mass or more of carbon, and the balance being copper and inevitable imparities, with a carbon-to-element A mole ratio of 10.0 or less. The inevitable impurities include, for example, Fe, and the total content of the inevitable impurities is preferably 0.5% by mass or less, more preferably 0.2% by mass or less, and still more preferably 0.1% by mass or less.

The grain size of the copper alloy of the present invention measured by the intercept procedure specified in ASTM E112 is preferably 200 μm or less, more preferably 100 μm or less, and still more preferably 50 μm or less. A smaller grain size leads to a higher ductility. Preferably, the "elongation after fracture" of the copper alloy of the present invention is 10% or more. Preferably, the tensile strength of the copper alloy of the present invention is 915 MPa or more. The copper alloy of the present invention may be in the shape of, for example, a plate, a strip, a line, a bar, a tube, or a block, and may have any other shape.

The copper alloy of the present, invention may foe prepared in the following manufacturing process. The manufacturing process of the copper alloy may include, for example, (a) melting and casting step, (b) homogenization heat treatment step, (c) hot working step, (d) solution heat treatment step, and (e) hardening heat treatment step. Each of the steps will be described below.

(a) Melting and Casting Step

In this step, raw materials are melted and subjected to casting. Any substances nay be used as the raw materials without particularly limitation as long as a desired composition, can be prepared. For the raw materials of Cu, Ni, Sn, and element A (and additive elements), elementary substances of these elements or alloys containing two or more of these elements may be used. For the raw material of carbon, a carton-containing furnace or crucible or a carbon-containing covering material for the molten metal may be used, and this carbon is used as the raw material of carbon. In this instance, only one of the furnace, crucible, covering material and the like may contain carbon, or two or more of them may contain carbon. The carbon in the furnace, crucible, covering material of molten metal, or the like may be graphite, coke or carbon black. The carbon content in the copper alloy can be adjusted by controlling the type of the furnace or crucible material, the type and amount of the covering material, the contact time with carton, the temperature of contact with carbon, the contact area with carbon, or the like.

The casting may be performed by a fully continuous process, a semi-continuous process or a batch process. Alternatively, horizontal casting, vertical casting or the like may be applied. The ingot may be in the form of, for example, a slab, a billet, a bloom, a plate, a bar, a tube, or a block, and may be in any other form.

(b) Homogenization Heat Treatment Step

In this step, the copper alloy obtained in Step (a) is heat-treated to eliminate or reduce in amount non-uniform textures, such as micro-segregates and compounds produced in nonequilibrium manner during casting, which may affect the subsequent steps, thus forming a uniform texture. The homogenization heat treatment may be performed by holding the alloy at a temperature, for example, in the range of 700° C. to 1000° C., preferably 800° C. to 900° C., for a period in the range of 3 hours to 24 hours, preferably 8 hours to 20 hours. In an alloy containing a large amount of Ni or Sn, the Ni or Sn is liable to segregate. The homogenization heat treatment however eliminates or reduces in amount, for example, the micro-segregates of Ni or Sn in the ingot, thus reducing the occurrence of cracks during hot working and preventing remaining non-uniform Sn enriched phases in the copper alloy from degrading the elongation and fatigue property of the alloy.

(c) Hot Working Step

In this step, the copper alloy obtained in Step (b) is hot-worked into a desired shape. The hot working may be performed, by, for example, hot rolling, hot extrusion, hot drawing, hot forging, or the like. These hot working methods may be combined. The hot rolling may be flat rolling using flat rolls, or other rolling, such as groove rolling using grooved rolls. The hot working may be performed at a temperature in the range of 600° C. to 900° C., preferably 700° C. to 900° C. The cross-section, area reduction by hot working (=(cross-section area before hot working−cross-section area after hot working)/cross-section area before hot working) may foe 50% or more, 70% or more, or 80% or more. If hot forging is performed as the hot working, the equivalent strain produced in the hot forging may be 0.5 or more, 3 or more, or 5 or more. The equivalent strain is defined as the sum of the absolute values of natural logarithms of the ratio of cross-section areas before and after working.

(d) Solution Heat Treatment Step

In this step, the copper alloy obtained in Step (c) is heated and then rapidly cooled to dissolve Ni, Sn and the like in Cu for forming a solid solution. The solution heat treatment may be performed by holding the alloy, for example, at a temperature in the range of 700° C. to 950° C. for a period in the range of 5 seconds to 6 hours, and subsequently cooling the alloy immediately and rapidly at a cooling rate of 20° C./s or more using water, oil or air. In the case of a copper alloy based on a composition of Cu-9% by mass Ni-6% by mass Sn or a composition, of Cu-21% by mass Ni-5% by mass Sn, the alley is preferably held at a temperature in the range of 750° C. to 850° C. for a period in the range of 5 seconds to 500 seconds (more preferably in the range of 30 seconds to 240 seconds), and then immediately cooled with water. In the case of a copper alloy based on a composition of Cu-15% by mass Ni-8% by mass Sn, the alloy is preferably held at a temperature in the range of 790° C. to 870° C. for a period in the range of 0.75 hour to 6 hours (more preferably in the range of 1 hour to 4 hours), and then immediately cooled with water.

(e) Hardening Heat Treatment Step

In this step, the copper alloy obtained in Step (d) is subjected to heat treatment for spinodal decomposition and is thus hardened. The hardening heat treatment may be performed, for example, at a temperature in the range of 300° C. to 500° C. for a period in the range of 1 hour to 10 hours. In the case of a copper alloy based on a composition of Cu-15% by mass Ni-8% toy mass Sn, the alloy may be held at a temperature in the range of 320° C. to 420° C. for a period in the range of 1 hour to 10 hours. In the case of a copper alloy based on a composition of Cu-9% by mass Ni-6% by mass Sn, the alloy may be held at a temperature in the range of 300° C. to 450° C. for a period in the range of 2 hours to 3 hours. In the case of a copper alloy based on a composition of Cu-21% by mass Ni-5% toy mass Sn, the alloy may be held at a temperature in the range of 350° C. to 500° C. for a period in the range of 2 hours to 3 hours. If a thin plate is subjected to mill hardening heat treatment, the holding time can be shortened in each of the above cases because the thin plate has a small heat capacity.

The above-described copper alloy of the present invention is superior in ductility. Accordingly, the copper alloy can be used in, for example, articles required to have a high strength and a large elongation after fracture. Since the copper alloy exhibits satisfactory ductility at high temperatures, and is accordingly not liable to crack during hot working. Furthermore, the copper alloy that has been subjected to solution heat treatment and hardening heat treatment has high strength, and exhibits high ductility and high absorbed energy of Charpy impact test, and is accordingly expected to be used, in wider range of applications including an application requiring high reliability. In general, copper alloys having a large Sn content core liable to crack during hot working. In contrast, the copper alloy of the present invention is not liable to crack during hot working in spite of a relatively high Sn content. Also, in copper alloys having a large Ni content, carton dissolved in the copper alloy can precipitate as graphite after solidification. This degrades the ductility of the copper alloy during hot working or the resulting product. Even if precipitate of graphite is not observed in the alloy, the carbon atoms that form a solid solution in the alloy may inhibit the migration of dislocation when the material is plastically deformed, and thus degrade the ductility of the copper alloy during hot working or the resulting produce. In contrast, the copper alloy of the present invention exhibits satisfactory ductility during hot working or in the resulting product in spite of a relatively high Ni content.

Furthermore, since the copper alley of the present invention is superior in ductility and good in workability during hot working or cold working, wide varieties of manufacturing methods and intended product, shapes can be applied. Known Cu—Ni—Sn-based copper alloys, of which the hot working is difficult, are casted into plates toy a horizontal continuous casting process capable of casting with dimensions relatively close to the intended product dimensions, and then, the plates are worked into articles in a strip shape, such as thin plates, through repetitions of cold rolling and annealing. On the other hand, the copper alloy having the composition according to the present invention is superior in ductility and is not liable to crack during hot forging or hot rolling of the ingot. The copper alloy of the present invention can therefore be relatively easily worked into dimensions or a shape relatively close to the dimensions or shape of the intended product. Thus, casting methods other than horizontal continuous casting can be applied irrespective of the dimensions or shape of the ingot. The known horizontal continuous casting does not cause a large problem in large-lot mass production. In the case of small-lot production, however, molten metal tends to remain in the horizontal melting holding furnace and results in a reduced yield. The copper alloy of the present invention however can be casted by, for example, vertical continuous casting and can be casted in a small lot production with a high yield, accordingly being suitable for semi-continuous casting as well as fully continuous casting. Since vertical continuous casting can be applied, round ingots and rectangular ingots can be easily produced. Such a round ingot or rectangular ingot can be easily forged into a product in a block or billet shape having a large cross section, with an aspect ratio close to 1. Also, the copper alloy of the present invention is good in workability in hot rolling or cold rolling and can be worked into products in various shapes. Accordingly, the copper alloy is expected to be used for products other than thin plates and strips.

The copper alloy of the present invention, which is a Cu—Ni—Sn-based copper alloy having a high strength and a low friction coefficient, can be suitably used for sliding parts, such bearings, and structural members such as bars, tubes and blocks. The copper alloy is suitable for use as leaf springs (thin plate strip materials) of connectors or the like because of high strength, electric conductivity and bending formability thereof. Furthermore, the copper alley is superior in stress relaxation characteristic and is accordingly suitable for use as terminals such as burn-in socket that are used in high-temperature environment.

The present invention is not limited to the above-described embodiment, and it should be appreciated that various forms can be applied to the invention within the technical scope of the invention.

For example, the copper alloy of the above-described embodiment is prepared in a manufacturing process including Steps (a) to (e). The process is not limited to this. For example, the process may consist of Step (a), omitting Steps (b) to (e). The As-cast material produced through such a process is suitably used in Steps (b) to (e) and the like, and has good workability and can provide a highly ductile and strong article. The manufacturing process may omit Steps (c) to (e), Step (d) and (e), or step (e). The resulting material produced through such a process is suitably used in the operation of the omitted step or the like.

The manufacturing process of the copper alloy may further include a cold working step between. Steps (d) and (e). The cold working may be performed by, for example cold rolling, cold extrusion, cold drawing, cold forging, or the like. These cold working methods may be combined. The cold working step may be substituted for Step (c), or may be performed between Steps (c) and (d). In this instance, the cold working step and an annealing step may be repeated. The cold working may be performed by any one of the above-mentioned methods.

EXAMPLES

Specific examples of the copper alloy will now be described as Experimental Examples. Experimental Examples 3, 4, 6, 8 to 12, 14, 16 and 17 correspond to Examples of the present invention, and Experiment Examples 1, 2, 5, 7, 13 and 15 correspond to Comparative Examples. The present invention is not limited to the following Experimental Examples, and it should be appreciated that various forms can be applied to the invention within the technical scope of the invention.

Experimental Examples 1 to 12

(Preparation of Copper Alloy)

Raw materials including electrolytic copper, electrolytic nickel, tin and 35% by mass Mn—Cu alloy were melted in a graphite or ceramic crucible in an argon atmosphere in a high-frequency induction melting furnace to yield a 110 mm in diameter by 200 mm ingot of Cu-15% by mass Ni-8% by mass Sn-0.2% by mass Mn alloy containing additive elements shorn in Table 2. The Nb source was 60% by mass Nb—Ni; the Zr source was metallic Zr; and the Ti source was metallic Ti. As a carbon source, a graphite-containing covering material for molten metal was optionally used. The carbon content was controlled by varying the type and amount of the covering material added to the molten metal, the contact time between the molten metal and the covering material, or the temperature at which the molten metal was held. The amounts of element A shown in the Tables were values measured by a wet chemical analysis (ICP), and the amounts of carbon in the Tables were values measured by a infrared absorption method after combustion in oxygen flow with a carbon analyzer.

After being held at 900° C. for 8 hours for homogenization heat treatment, the ingot was cut into a 42 mm in diameter×95 mm round bar as a material for hot rolling with grooved rolls. The round bar was heated to 850° C. and then rolled into a rectangular bar with a cross section of about 16 mm×16 mm by the rolling. The states of cracks that occurred after the rolling are shown in Table 2. The state of cracks ware evaluated according to the following: samples that fractured while the sample is under the rolling or machining were rated as "fractured"; samples in which five or more cracks of 3 mm or more in depth occurred within a length of 100 mm were rated as "large"; samples in which one to four cracks of 3 mm or more in depth occurred within a length of 100 mm were rated as "rather large"; samples in which five or more cracks of less than 3 mm in depth occurred within a length of 100 mm whereas cracks of 3 mm or more in depth did not occur were rated as "middle"; and samples in which four or less cracks of less than 3 mm in depth occurred within a length of 100 mm whereas cracks of 3 mm or more in depth did not occur were rated as "small". For reference, FIG. 1 shows appearance photographs, of samples after being subjected to the rolling in Experimental Examples 2, 4, 9 and 12.

After being heated at 830° C. for 2 hours, the groove-rolled bar was immediately cooled in water for solution treatment, and then subjected to hardening heat treatment at 370° C. for 4 hours. The resulting rectangular bar was worked into a specimen for tensile test, and the specimen was subjected to tensile test (according to JIS Z 2241, the same applies hereinafter) at room temperature. The results of the tensile test are shorn in Table 2.

(Experiment Results and Consideration)

In Experimental Examples 1 and 2, in which element A was not added, cracks occurred markedly during the hot rolling with grooved rolls. Consequently, the samples were not worked into specimens for tensile test, or the specimens exhibited very small elongation in the tensile test. In Experimental Examples 3 to 12, in which element A was added, cracks that occurred during the hot rolling were smaller than in Experimental Examples 1 and 2, and elongation was larger in the tensile test.

Figure 2:
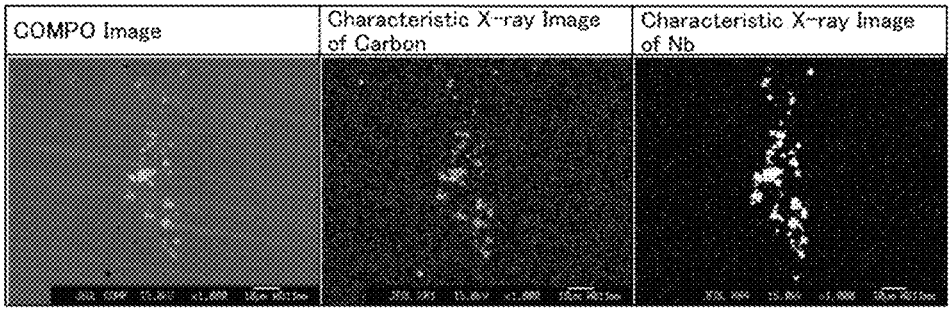
FIG. 2 shows an electron micrograph and characteristic X-ray images of the ingot of Experimental Example 6.

In Experimental Examples 3 to 6, Nb was added as element A. Among these Experimental Examples, Experimental Examples 3, 4 and 6 containing 0.005% by mass or more of carbon exhibited larger elongation and higher tensile strength than Experimental Example 5 containing 0.002% by mass of carbon. These results reversed the common perception that Cu alloys containing a relatively large amount of Ni tend to have a lower ductility (becomes brittler) as the carbon, content is increased. In the observation of microstructure of Experimental Examples 1 to 6, many phases (having a grain size of the phase about 3 μm to 5 μm, for large grains) that were assumed to be Nb carbide were observed in Experimental Examples 3, 4 and 6. On the other hand, in Experimental Examples 1, 2 and 5, there were observed no phases or few phases that were assumed, to be carbide. FIG. 2 shows an electron micrograph (COMPO image, the same applies hereinafter) and EPMA analysis results (characteristic X-ray images of carbon and niobium) of the ingot of Experimental Example 6. The white granular phase in the COMPO image was observed at the same position as the white portions in the characteristic X-ray images representing the presence of carbon or niobium. This suggests that the white phase is a Nb carbide phase. The average grain sizes of the microstructure after being subjected to hardening heat treatment in Experimental Examples 4, 5 and 6 were measured by the intercept procedure specified in ASTM E112. The results were 45 μm, 211 μm and 115 μm, respectively. From these results, it is assumed that, in copper alloys containing appropriate amounts of Nb and carbon, elemental carbon and interstitial carbon that are the cause of decrease in ductility (beaming brittle) are reduced in amount by being used for the formation of the Nb carbide, and that the pinning effect of the Nb carbide allows the crystal grains to become finer and thus increases elongation and tensile strength.

Figure 3:
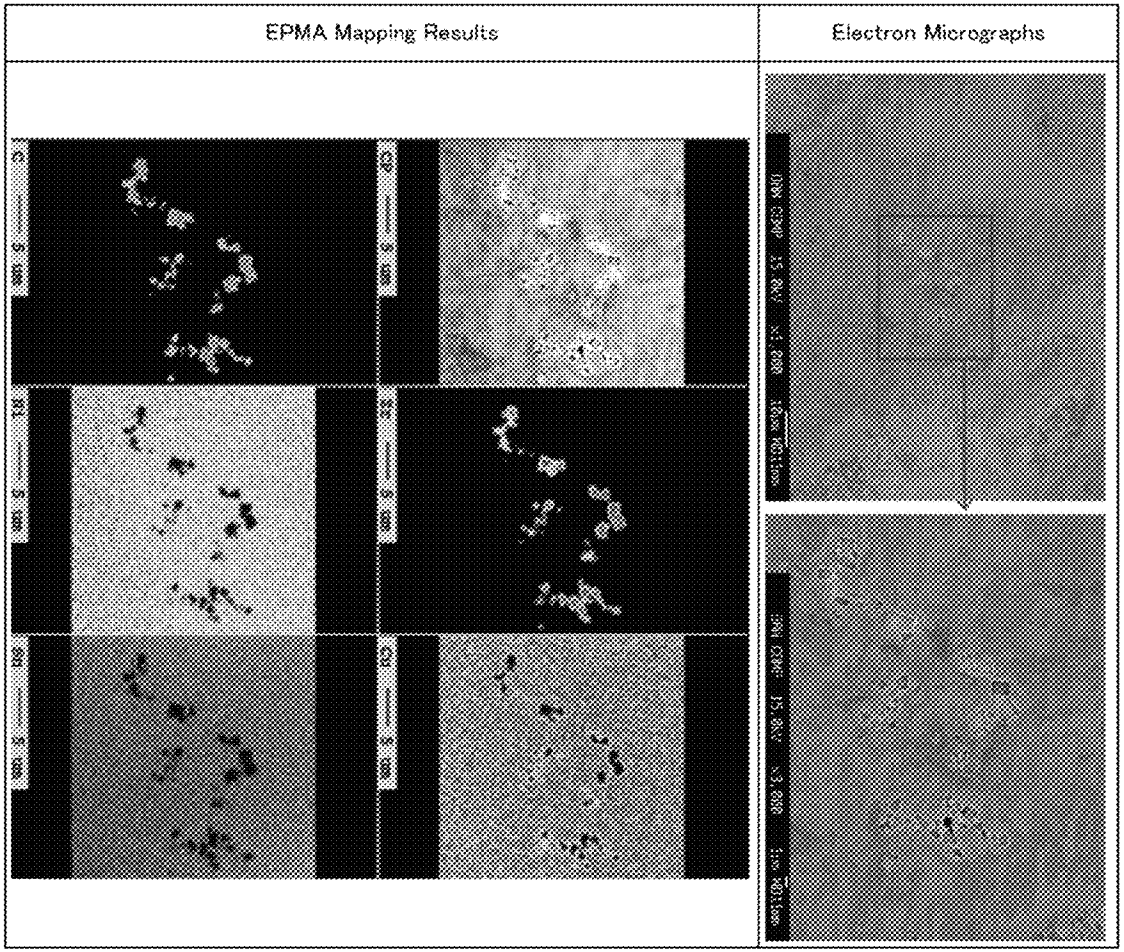
FIG. 3 shows electron macrographs and EPMA mapping results of the ingot of Experimental Example 9.
Figure 4:
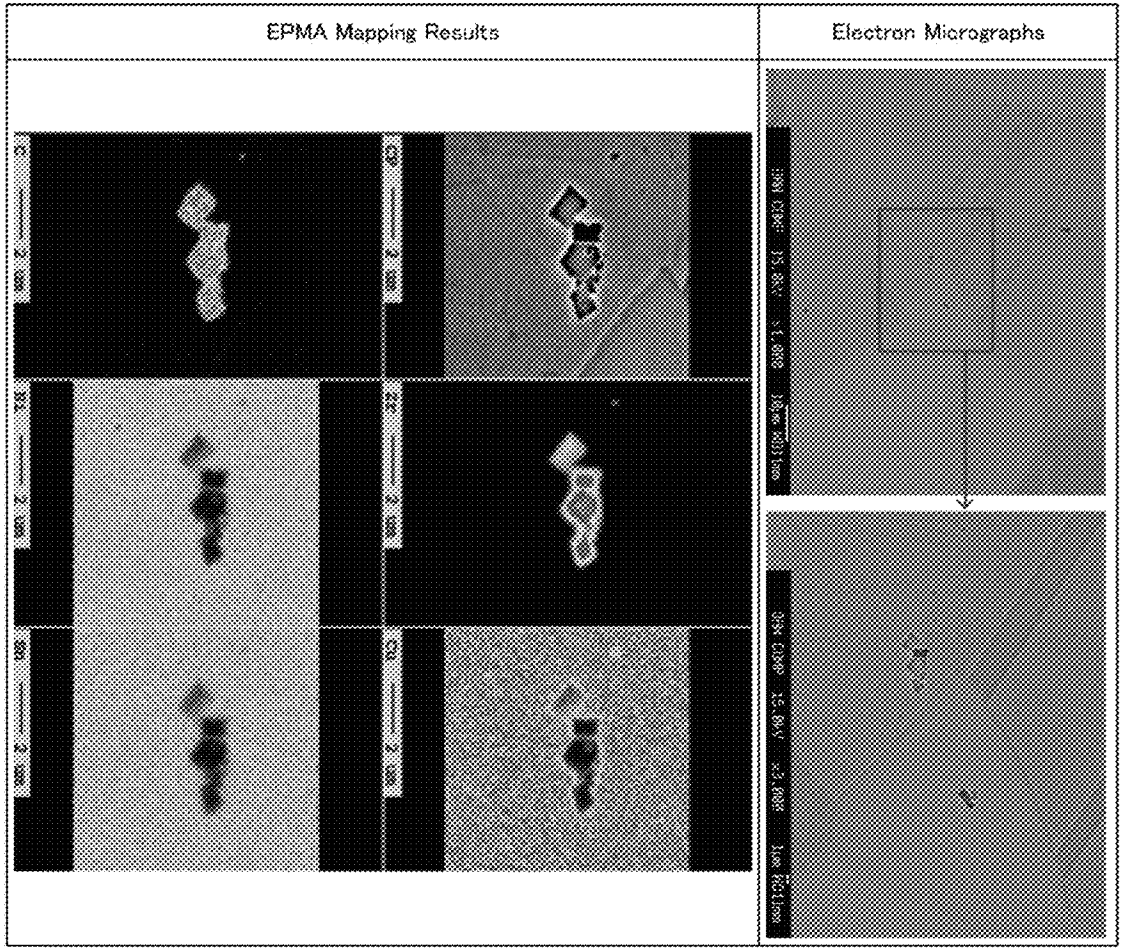
FIG. 4 shown electron micrographs and EPMA mapping results of the sample of Experimental Example 8 after being subjected to hardening heat treatment.
Figure 5:
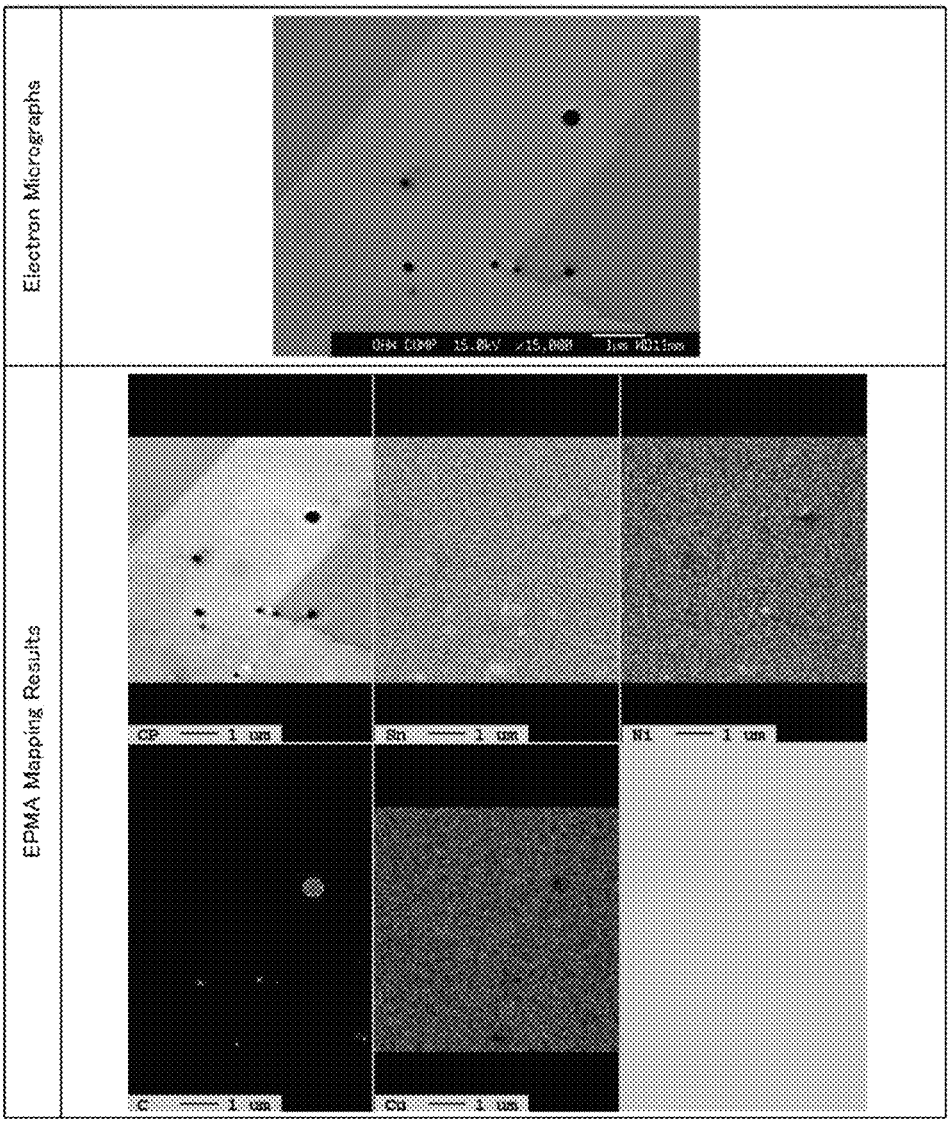
FIG. 5 shows an electron micrograph and EPMA mapping results of the sample of Experimental Example 2 after being subjected to hot rolling (after being fractured).

In Experimental Examples 7 to 11, Zr was added as element A. Among these Experimental Examples, Experimental Examples 8 to 11 with a MC/MA mole ratio of 10.0 or less exhibited larger elongation and higher tensile strength than Experimental Example 7 with a MC/MA, mole ratio of 10.3. Also, Experimental Example 9 having a higher carbon content than Experimental Example 7 exhibited larger elongation and higher tensile strength than Experimental Example 7. These results suggest that the upper limit of the carton content varies depending on the element A content. It is assumed that the elongation, of a sample with a large MC/MA mole ratio is small because of the presence of an excessively large amount of carbon not forming Zr carbide. FIG. 3 shows electron micrographs and EPMA mapping results of the microstructure of the ingot of Experimental Example 9. FIG. 4 shows electron micrographs and EPMA mapping results of the copper alloy after being subjected to hardening heat treatment in Experimental Example 8. In the EPMA mapping results shown in FIGS. 3 and 4, the images denoted by CP are COMPO images at positions of mapping performed, and images denoted by Zr, Cu, C, Ni, or Sn are EPMA mapping images of the corresponding element. The higher content of the corresponding element, is the whiter mapping image, which is originally a color image. In portions in the EPMA mapping images corresponding to the angulated phases in the COMPO images, larger amounts of carbon and Zr were observed, while Cu, Ni and Sn were smaller in amount. These results suggest that the angulated phases were Zr carbide phases. The phases that were assumed to be Zr carbide phases were further subjected to composition analysis (at three points for each) using a COMPO image (×3000). The results are shown in Table 1. As shown in Table 1, the mole ratio of Zr to carbon in the angulated phases was about 1:1, and this suggests that the phases were of ZrC. The average grain size of the microsfracture after being subjected to hardening heat treatment in Experimental Example 8, measured by the intercept procedure specified in ASTM E112, was 48 μm. Similarly, the average grain sizes of the microstructure after being subjected to hardening heat treatment in Experimental Examples 9 and 11, measured in the same manner, were each 35 μm. From these results, it is assumed that, in copper alloys containing appropriate amounts of Zr and carbon, elemental carbon and interstitial carbon that are the cause of decrease in ductility (becoming brittle) are reduced in amount by being used for the formation of carbide with the Zr, and that the effect of the Zr carbide to pin dislocation allows the crystal grains to become finer and thus increases elongation and tensile strength. For the sake of comparison, FIG. 5 shows an electron micrograph and EPMA mapping images of Comparative Example 2. FIG. 5 suggests that samples not containing element A causes carbon to precipitate, and that such a microstructure reduces ductility.

TABLE 1

| Ingot (Experimental Example 9) | | | | After being subjected to hardening heat treatment (Experimental Example 8) | | | |
|---|---|---|---|---|---|---|---|
| No | C Atomic % | Zr Atomic % | Total Atomic % | No | C Atomic % | Zr Atomic % | Total Atomic % |
| Average | 45.7 | 54.3 | 100.0 | Average | 46.7 | 53.3 | 100.0 |
| 1 | 45.5 | 54.5 | 100.0 | 4 | 48.2 | 51.8 | 100.0 |
| 2 | 46.4 | 53.6 | 100.0 | 5 | 46.2 | 53.8 | 100.0 |
| 3 | 45.1 | 54.9 | 100.0 | 6 | 45.6 | 54.4 | 100.0 |

In Experimental Example 12, Ti was added as element A. The elongation and tensile strength of this Example were also large. From these results, it is assumed that, in copper alloys containing appropriate amounts of Ti and carbon, elemental carbon and interstitial carbon that, are the cause of decrease in ductility (becoming brittle) are reduced in amount by being used for the formation of carbide with the Ti, and that the pinning effect of the Ti carbide allows the crystal grains to become finer and thus increases elongation and tensile strength.

TABLE 2

| | Additive elements | | | | | Evaluation | | |
|---|---|---|---|---|---|---|---|---|
| | Element A | | | | Mole ratio | Cracks occurred after rolling with | Tensile | |
| | Nb mass % | Zr mass % | Ti mass % | C mass % | MC/MA — | grooved rolls — | strength MPa | Elongation % |
| Expenmental Example 1 | Not added | Not added | Not added | 0.003 | — | Large | 755 | 1.2 |
| Experimental Example 2 | Not added | Not added | Not added | 0.018 | — | Fractured | Specimen could not be prepared | |
| Experimental Example 3 | 0.015 | Not added | Not added | 0.007 | 3.6 | Small | 915 | 15.0 |

TABLE 2-continued

| | Additive elements | | | | | Evaluation | | |
|---|---|---|---|---|---|---|---|---|
| | Element A | | | | Mole ratio | Cracks occurred after rolling with | Tensile | |
| | Nb mass % | Zr mass % | Ti mass % | C mass % | MC/MA — | grooved rolls — | strength MPa | Elongation % |
| Experimental Example 4 | 0.040 | Not added | Not added | 0.020 | 3.9 | Middle | 949 | 19.2 |
| Experimental Example 5 | 0.050 | Not added | Not added | 0.002 | 0.3 | Large | 848 | 4.9 |
| Experimental Example 6 | 0.085 | Not added | Not added | 0.021 | 1.9 | Middle | 936 | 15.3 |
| Experimental Example 7 | Not added | 0.036 | Not added | 0.049 | 10.3 | Large | 910 | 4.5 |
| Experimental Example 8 | Not added | 0.079 | Not added | 0.013 | 1.3 | Small | 954 | 15.1 |
| Experimental Example 9 | Not added | 0.084 | Not added | 0.058 | 5.2 | Small | 946 | 25.0 |
| Experimental Example 10 | Not added | 0.184 | Not added | 0.010 | 0.4 | Small | 972 | 17.0 |
| Experimental Example 11 | Not added | 0.278 | Not added | 0.009 | 0.2 | Middle | 964 | 19.3 |
| Experimental Example 12 | Not added | Not added | 0.080 | 0.031 | 1.5 | Small | 916 | 12.5 |

Experimental Examples 13 and 14

(Preparation of Copper Alloy)

Raw materials including electrolytic copper, electrolytic nickel, tin and 35% by mass Mn—Cu alloy were melted in a graphite, crucible in an argon atmosphere in a high-frequency induction melting furnace to yield an ingot of Cu-15% by mass Ni-8% by mass Sn-0.2% by mass Mn alloy containing additive elements shown in Table 3. The sound part of the ingot measured 275 mm in diameter×500 mm. The Nb source was 60% by mass Nb—Ni alloy. The carbon source was the graphite crucible, and the carton content was adjusted by controlling the contact time between the graphite crucible and the rah ten metal or the time at which the molten metal was held.

After being held at 900° C. for 8 hours for homogenization heat treatment, the ingot was turned at the surface and was hot-extruded into a round bar of about 100 mm in diameter at 850° C. After being heated at 830° C. for 2 hours, the round bar was immediately cooled in water for solution treatment, and then subjected to hardening heat treatment at 370° C. for 4 hours. The resulting round bar was worked into a specimen for tensile test, and the specimen was subjected to tensile test at roan temperature. The results of the tensile test are shown in Table 3.

(Experiment Results and Discussion)

Experimental Example 14, in which element A was added, exhibited a lager elongation in the tensile test than the Experimental Example 13, in which element A was not added. Experimental Example 14 also exhibited a high tensile strength as a whole.

TABLE 3

| | Additive elements | | | | Evaluation | | |
|---|---|---|---|---|---|---|---|
| | Element A | | | Mole ratio | Position where the specimen | Tensile | |
| | Nb mass % | Zr mass % | C mass % | MC/ MA — | was obtained — | strength MPa | Elongation % |
| Experimental Example 13 | Not added | Not added | 0.010 | — | Center of nose portion | 916 | 5.5 |
| | | | | | Peripheral of nose portion | 908 | 4.1 |
| | | | | | Center of near butt-end portion | 918 | 8.9 |
| | | | | | Peripheral of near butt-end portion | 930 | 6.7 |
| Experimental Example 14 | 0.026 | Not added | 0.015 | 4.5 | Center of nose portion | 924 | 11.1 |
| | | | | | Peripheral of nose portion | 955 | 12.7 |
| | | | | | Center of near | 929 | 14.1 |

TABLE 3-continued

| Additive elements | | | | Evaluation | | |
|---|---|---|---|---|---|---|
| Element A | | | Mole ratio | Position where the specimen was obtained | Tensile strength | Elongation |
| Nb mass % | Zr mass % | C mass % | MC/ MA — | — | MPa | % |
| | | | | butt-end portion Peripheral of near butt-end portion | 948 | 15.5 |

Experimental Examples 15 to 17

Raw materials including electrolytic copper, electrolytic nickel, tin and 35% by mass Mn—Cu alloy were melted in a graphite crucible in an argon atmosphere in a high-frequency induction melting furnace to yield an ingot of Cu-15% by mass Ni-8% by mass Sn-0.2% by mass Mn alloy containing additive elements shown in Table 4. The sound part of the ingot measured 275 mm in diameter×380 mm. The Nb source was 60% by mass Nb—Ni alloy, and the Zr source was metallic Zr. The carbon source was the same graphite crucible as in Experimental Examples 13 and 14.

The ingot, surface of which was turned was held at 900° C. for 8 hours for homogenization heat treatment and was then cooled to 850° C. The sample was subjected to hot forging for an intended round bar of about 180 mm in diameter×600 mm with an equivalent strain of 6.

Figure 6:
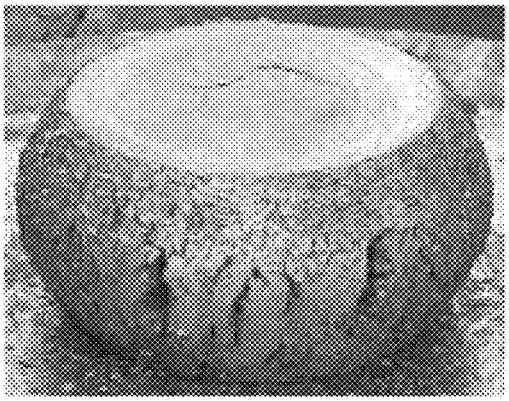
FIG. 6 shows a photograph of the appearance of a forged product of Experimental Example 15.
Figure 7:
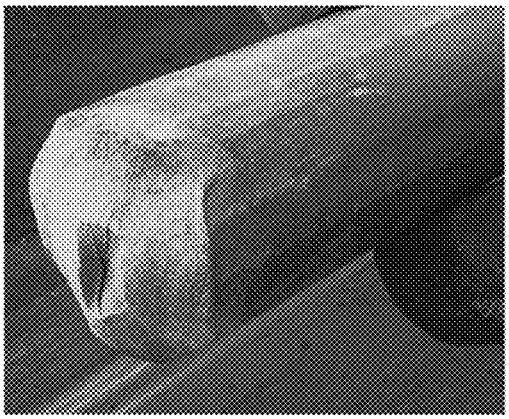
FIG. 7 shows a photograph of the appearance of a forged product of Experimental Example 16.
Figure 8:
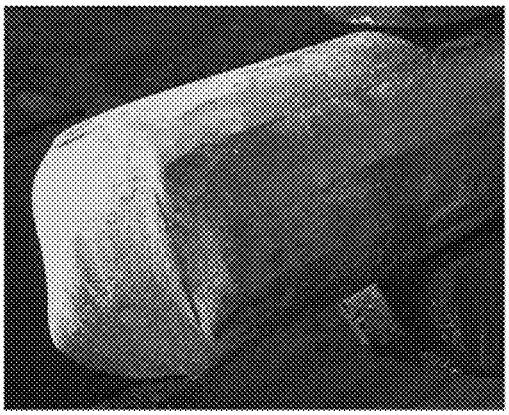
FIG. 8 shows a photograph of the appearance of a forged product of Experimental Example 17.

In Experimental Example 15, in which element A was not added, a plurality of large cracks occurred in the side surfaces at the time when upsetting was performed with an equivalent strain of 0.7. Therefore the subsequent forging was canceled. In Experimental Examples 16 and 17, in which element A was added, upsetting and forging were alternately repeated to an equivalent strain of 6 while relative small creases and cracks in the surface were removed by grinding. In Experimental Example 16, a crack that could be removed by cutting occurred in one end of the round bar during the final forging operation. In Experimental Example 17, forging was completed without occurrence of marked, cracks. FIGS. 6 to 8 show the appearances of forged products of Experimental Examples 15 to 17. It was thus confirmed that the copper alloy of the present invention can be subjected to hot forging; and relatively easily worked into various shapes. Accordingly, the copper alloy is expected to be used in a wide range of applications.

TABLE 4

| | Additive elements | | | | Evaluation |
|---|---|---|---|---|---|
| | Element A | | | Mole ratio | Equivalent strain |
| | Nb mass % | Zr mass % | C mass % | MC/MA — | (target value: 6) — |
| Experimental Example 15 | Not added | Not added | 0.012 | — | 0.7 |
| Experimental Example 16 | 0.072 | Not added | 0.013 | 1.4 | 6 ※ |

TABLE 4-continued

| | Additive elements | | | | Evaluation |
|---|---|---|---|---|---|
| | Element A | | | Mole ratio | Equivalent strain |
| | Nb mass % | Zr mass % | C mass % | MC/MA — | (target value: 6) — |
| Experimental Example 17 | Not added | 0.099 | 0.011 | 0.8 | 6 |

※ Relative small creases and cracks occurred in the surface, but the forging was operated while cracks wore removed by grinding The present application claims priority from Japanese Patent Application No. 2015-087888 filed on Apr. 22, 2015, the entire contents of which are incorporated herein by reference.

INDUSTRIAL APPLICABILITY

The present invention can be applied to the field related to copper alloy.

What is claimed is:

1. A copper alloy containing 5% by mass to 25% by mass of Ni, 5% by mass to 10% by mass of Sn, 0.005% by mass to 0.5% by mass of element A, said element A being at least one element selected from the group consisting of Nb, Zr and Ti, and 0.020% by mass or more of carbon, wherein the mole ratio of the carbon to the element A is 10.0 or less.

2. The copper alloy according to claim 1, containing more than 10% by mass of the Ni.

3. The copper alloy according to claim 1, containing at least one additive element selected from the group consisting of Mn, Zn, Mg, Ca, Al, Si, P and B, with the content in the range of 0.01% by mass to 1% by mass.

4. The copper alloy according to claim 1, wherein at least part of the element A is present as carbide.

5. The copper alloy according to claim 1, wherein the copper alloy exhibits an elongation after fracture of 10% or more.

6. The copper alloy according to claim 1, wherein the copper alloy has a tensile strength of 915 MPa or more.

7. The copper alloy according to claim 1, wherein the balance of the composition of the copper alloy is Cu and inevitable impurities.

8. The copper alloy according to claim 3, wherein the balance of the composition of the copper alloy is Cu and inevitable impurities.

9. The copper alloy according to claim 1, wherein the copper alloy is attained by melting and casting.

* * * * *